United States Patent [19]

Grines

[11] Patent Number: 4,840,000

[45] Date of Patent: Jun. 20, 1989

[54] MODULAR SALON STATION

[76] Inventor: Tyrone C. Grines, 3735 Kensington St., Kansas City, Mo. 64128

[21] Appl. No.: 205,332

[22] Filed: Jun. 10, 1988

[51] Int. Cl.[4] ..... A47C 1/04

[52] U.S. Cl. ..... 52/36; 52/32; 312/198; 297/346

[58] Field of Search ..... 52/32, 36; 312/198, 312/199, 229; 297/346, 143

[56] References Cited

U.S. PATENT DOCUMENTS

| | | | |
|---|---|---|---|
| 2,658,810 | 10/1953 | Ellis et al. | 312/198 X |
| 2,962,132 | 11/1960 | Reinharet | 52/27 X |
| 3,395,500 | 8/1968 | Smith | 52/36 X |
| 4,555,138 | 11/1985 | Hughes | 297/346 |
| 4,603,531 | 8/1986 | Nash | 52/806 X |

FOREIGN PATENT DOCUMENTS

| | | | |
|---|---|---|---|
| 873138 | 6/1971 | Canada | 297/346 |
| 2406435 | 6/1979 | France | 297/346 |
| 1594872 | 8/1981 | United Kingdom | 312/198 |

*Primary Examiner*—David A. Scherbel
*Assistant Examiner*—Lan Mai
*Attorney, Agent, or Firm*—Richard C. Litman

[57] ABSTRACT

A modular salon station has cabinet sections that lock together to form a section approximating that of a hexagon segment and having three sides. Within the partial enclosure made by the three cabinets a recliner/chair is movable on a bifurcated trace mechanism that is located in the floor of the salon station. A patron is moved from one module to another by the recliner/chair bifurcated track mechanism.

5 Claims, 4 Drawing Sheets

MODULAR SALON STATION

FIELD OF INVENTION

The present invention is a modular salon station in which the patron is moved along a guiding means from module to module in the hairdressing process.

BACKGROUND OF THE INVENTION

Hairdressing salons offer much in the way of hair styling and treatments. The hairdresser is a professional working in a highly competitive industry. As a businessperson in such a competitive industry there is a continual need for innovation. Moreover, as the retailing nature of a business location changes, many businesses find the need to relocate or to re-design the interior floorspaces of their establishments.

The present invention relates to hairdressing salons and, more particularly, to the construction of a module salon station that is movable in its entirety to make possible a "fresh look" to an establishment; the effect of remodeling without incurring most of the cost of remodeling.

This apparatus is also a means for providing a hairdressing station in which the various elements work cooperatively to effect an increase in convenience for the patron. A recliner/chair is movable within the salon station and automatically places the patron within the service area of each specialized salon module.

Further, this apparatus has provision for a wide variety of appurtenances, such as hair drying equipment, mirrors, cutting and trimming stations that are organized within the overall device so as to create a systematic and orderly method of hairstyling.

DESCRIPTION OF THE PRIOR ART

The following cited prior art references are found to be exemplary of the U.S. prior art. They are:

| | Inventor |
|---|---|
| U.S. Pat. No. | |
| 2,962,132 | Reinharet |
| 4,603,531 | Nash |
| British Prior Art | |
| 1,403,464 | Wood |
| Australian Patent No. | |
| 158,564 | Sickel |

U.S. Pat. No. 2,962,132, issued to Reinharet, discloses a movable self-standing wall partition which can be easily moved by means of adjustable wheels.

U.S. Pat. No. 4,603,531, issued to Nash, teaches a construction of a structural panel formed of honeycomb material.

British Pat. No. 1,403,464, issued to Wood, discloses a modular bathroom which features interconnecting floor and wall sections as well as a plumbing tree to provide water service to the structure.

Australian Pat. No. 158,564, issued to Sickel, discloses a collapsible and transportable building structure, which features folding panels and can be transported on wheels.

None of the prior art, whether taken singly or in combination, discloses the specific features and construction of the present invention so as to bear upon the claims as appended herein.

SUMMARY OF THE INVENTION

An object of the invention is to provide modular cabinetry having a recliner/chair movable across the modular station to effect a more convenient arrangement of the sitting/workspace in the salon station itself. The configuration of the guiding means automatically places a recliner/chair in the proper relative position within the modular station for a systematic progression in the hairstyling of a patron.

Another object is to provide a means for moving the station so as to vary the interior architecture and decorum of the establishment to meet changing business conditions, or to upgrade and present a "new look" which is quite important in businesses such as the hairdressing trade.

Another object is to configure the modular salon workstation so as to create a plurality of possible interior designs by "stacking" the modular station or arranging them in clusters within the available floorspace.

A further objective of the invention is to provide for the installation of electrical, plumbing and other utility and appurtenances within the modular station.

DESCRIPTION OF THE DRAWINGS

FIG. 4 also shows hookups to utilities such as electrical and plumbing to the workstation.

DESCRIPTION OF THE PREFERRED EMBODIMENT

Figure 1:
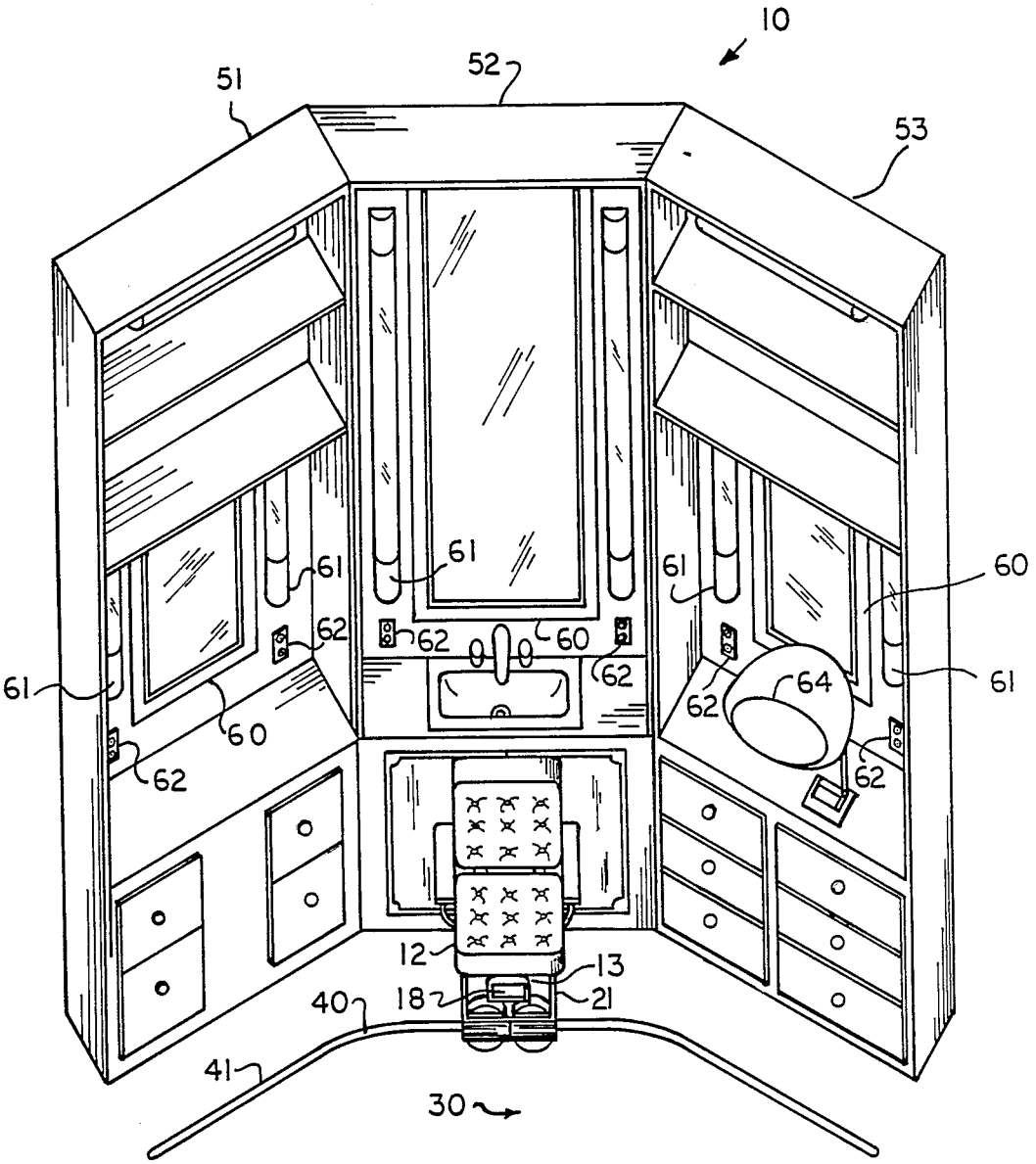
FIG. 1 is a perspective view of the device in use.

Referring now to the drawings, in which like elements refer to like elements throughout, FIG. 1 shows the modular salon station 10 including a chair 12 such as is typical in a hairdressing establishment, except for a motorized pedestal base 13 having motor 18 and upper guide wheels 21. The chair 12 is movable along guide track 40, which is set into the floor 30. Floor 30 also has casters 11 (not shown in this view) underneath, which may be extended downward to provide rolling support for the floor 30, then retracted upward to make the floor stationary for use.

The invention includes three modular cabinet sections 51, 52 and 53 that are arranged side to side in the position of three adjacent sides of an octagon. Each cabinet 51, 52, and 53 features a mirror 60, lights 61, and electrical outlets 62. In addition, hair washing cabinet 52 features a sink 63 and drying cabinet 53 features a dryer 64.

In operation, the salon stylist can easily move the seated patron from hair washing cabinet 52 to cut and trim cabinet 51 to drying cabinet 53, thereby carrying out all the steps of the hair salon activity in a compact space and without causing the patron the inconvenience of leaving his seat.

Figure 2:
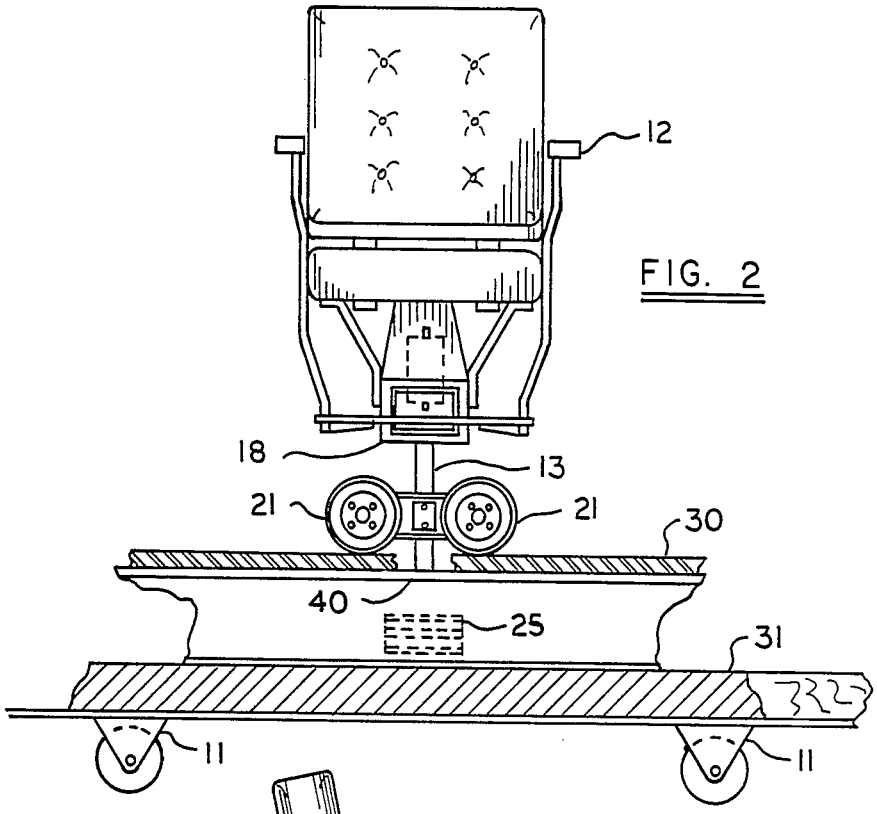
FIG. 2 is an elevational view of a recliner/chair mounted atop an upper and lower support arm and illustrating, by partial section view, a guiding means under the floorway of the device.
Figure 3:
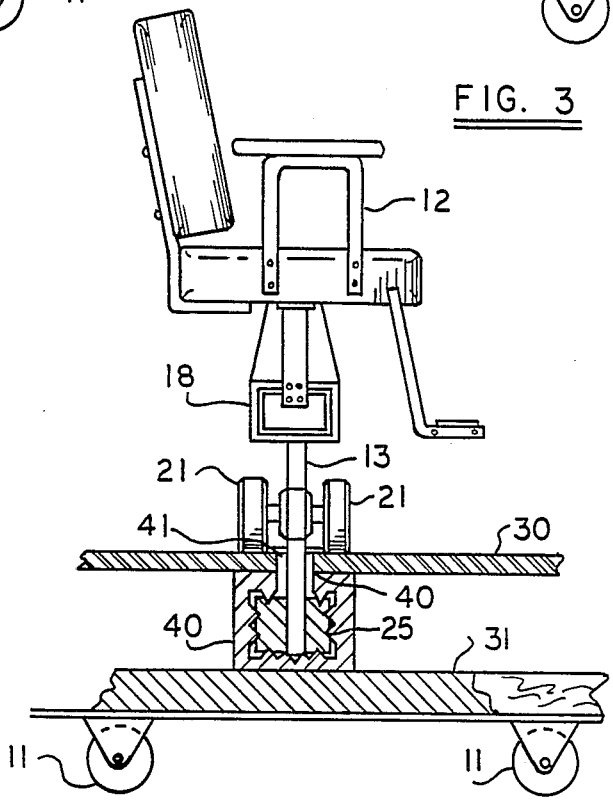
FIG. 3 is a side view of the recliner/chair and shows by partial section view the same elements of the underlying supporting and guiding apparatus of the device.

FIGS. 2 and 3 show a section of floor 30 having a subfloor 31 that may be supported by retractable casters 11. Chair 12 is mounted upon base 13 which includes a motor 18 and upper guide wheels 21, thereby supporting the base 13 and allowing the chair to be moved along guide track 40. The upper guide wheels 21 may be motor driven as shown. Alternatively, the motor may be omitted; the chair then being urged manually along free-rotating guide wheels 21 by the salon station operator. Base 13, in addition to motor 18 and upper guide wheels 21 has a lower guide block 25 affixed to its lower portion. Guide block 25 slides in the lower conduit of guide track 40, providing stability to base 13. The upper slot closure means 41 of guide track 40, such as a rubber flange on each side of the upper slot, may be included to help prevent hair clippings and debris from entering guide track 40.

Figure 4:
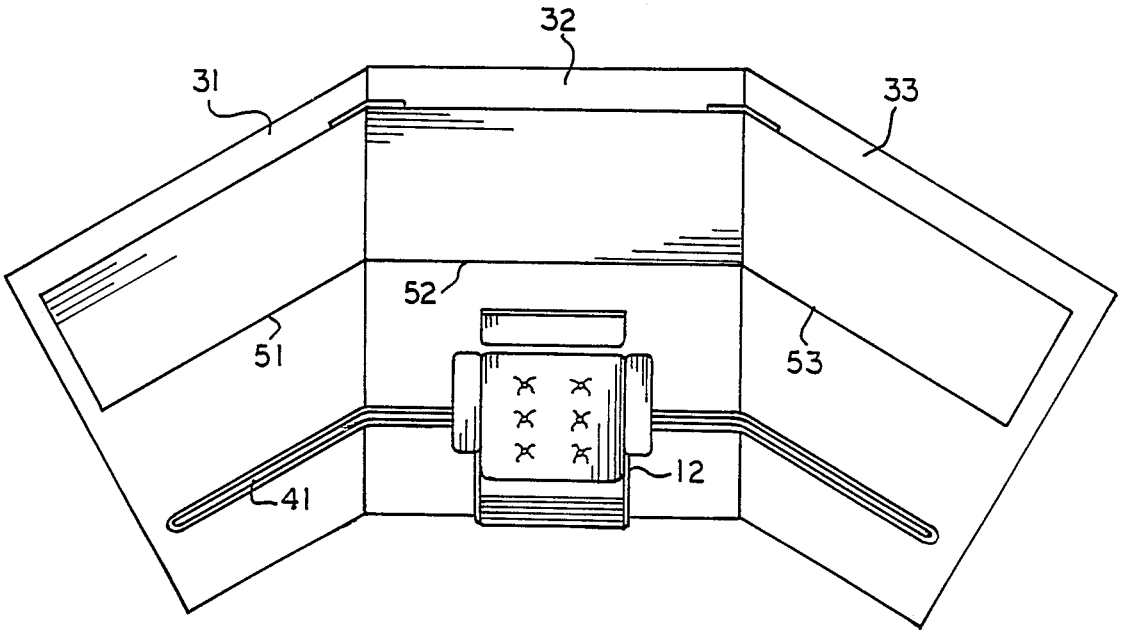
FIG. 4 is a top or plan view of the modular workstation and illustrates the preferred configuration for an upper floor element slotted aperture through which the recliner/chair glides from module to module within the station.

The plan view of FIG. 4 shows the layout of cabinets 51, 52, 53 in relation to chair 12, and guide track 40. FIG. 4 also shows an alternative embodiment wherein, floor 30 is divided into three detachable sections 31, 32 and 33.

Figure 5:
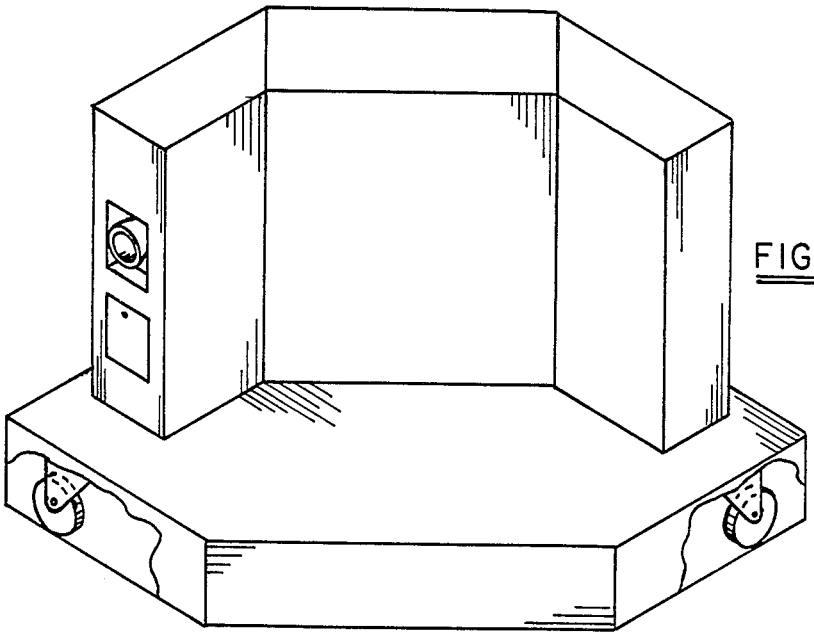
FIG. 5 is a perspective view showing casters upon which the device is movable.

FIG. 5 shows an alternative embodiment of the invention, where cabinet 51 has a jumpseat 91 and auxiliary dryer 92 mounted on the outer side thereof. The jumpseat 91 folds down hingedly from cabinet 51, and when folded up provides a flush surface with cabinet 51. Dryer 92 is pivotably mounted in dryer compartment 93, so that dryer 92 may be stored in a compartment 93 when not in use. This view also shows the placement of retractable casters 11 under floor 30.

Figure 6:
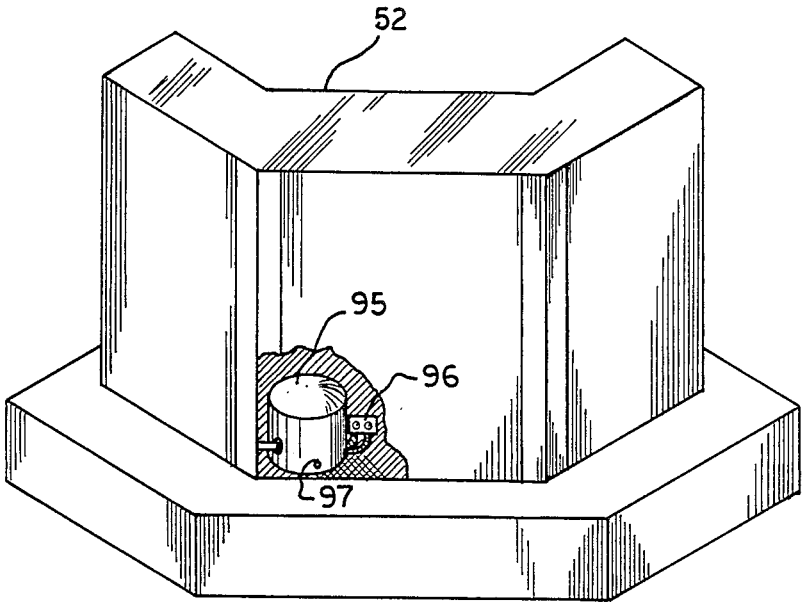
FIG. 6 is a rear perspective view of the preferred embodiment.

FIG. 6 shows an additional feature of the preferred embodiment, where hair washing cabinet 52 includes a water heater 95 and water and electrical meters 96. Water heater 95 includes a drain 97, so that the unit may easily be drained for storage or transport. This combination allows the invention to have a single water and electrical tie in, and further allows the consumption of water and electricity of each salon station to be monitored.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

I claim:

1. An apparatus for handling a salon patron, comprising;

a floor having an upper surface and a lower surface;

roller means retractably mounted to said lower surface of said floor;

means for defining a predetermined path along said upper surface of said floor;

a chair for handling said salon patron, said mobile chair being movable along said predetermined path;

means for coupling said mobile chair to said predetermined path, for guiding said chair along said path;

a plurality of cabinet modules attached to the upper surface of said floor; said cabinet modules disposed substantially parallel to said means for defining a predetermined path.

2. The apparatus of claim 1, wherein;

said floor is segmented into a plurality of connected floor segments, each of said floor segments having an upper surface and a lower surface, each of said floor segments having roller means retractably mounted to said lower surfaces of said floor segments.

3. The apparatus of claim 1, wherein;

said means for defining a predetermined path comprises a track in said floor, said track having a slot opening through said upper surface of said floor;

said mobile chair comprises a chair mounted on a pedestal, base having a lower shaft said pedestal having a second roller means attached thereto, said second roller means rolling along said top surface of said floor, thereby providing movable support for said mobile chair;

said means for coupling said mobile chair to said predetermined path comprises a guide block attached to a lower shaft, said lower shaft projecting downward from said pedestal base, through said slot, said guide block slidably disposed inside said slotted track.

4. The apparatus of claim 1 comprising;

powered motor means attached to said means for coupling said mobile chair to said predetermined path, whereby said chair may be selectively propelled along said predetermined path.

5. The apparatus of claim 1, wherein;

said cabinet modules include appliances for hair salon activity.

* * * * *